US005929890A

United States Patent [19]

Kakinuma et al.

[11] Patent Number: 5,929,890

[45] Date of Patent: Jul. 27, 1999

[54] METHOD OF AND DEVICE FOR FORMING A REVERSIBLE COLOR IMAGE

[75] Inventors: Takeo Kakinuma; Kensuke Ito; Minoru Koshimizu, all of Nakai-machi, Japan

[73] Assignee: Fuji Xerox Co., Ltd., Tokyo, Japan

[21] Appl. No.: 08/647,801

[22] Filed: May 15, 1996

[30] Foreign Application Priority Data

May 15, 1995 [JP] Japan ..... 7-138832

[51] Int. Cl.[6] ..... B41J 2/32

[52] U.S. Cl. ..... 347/172; 347/175

[58] Field of Search ..... 503/201, 204, 503/226; 347/171, 221, 172, 173, 174, 175, 176; 400/120.01, 120.02, 120.03, 120.04

[56] References Cited

U.S. PATENT DOCUMENTS 5,534,907 7/1996 Tsutsui et al. ..... 347/175

5,552,364 9/1996 Tsutsui et al. ..... 503/201

FOREIGN PATENT DOCUMENTS

A-6-24020 2/1994 Japan .

A-6-79970 3/1994 Japan .

*Primary Examiner*—Huan Tran

*Attorney, Agent, or Firm*—Oliff & Berridge, PLC

[57] ABSTRACT

A method of forming a reversible color image of forming a multi color image to a reversible heat sensitive color recording medium in which recording layers each containing independently a plurality kinds of reversible heat color forming compositions having tone of formed color and color erasure starting temperature different from each other are formed on a support, the method comprising forming colors of all the compositions in the initial state and heating the color formed compositions not imagewise at different temperatures thereby erasing the color of the composition (recording layer 2). The color image can be formed simply and rapidly at a high energy efficiency.

6 Claims, 9 Drawing Sheets

METHOD OF AND DEVICE FOR FORMING A REVERSIBLE COLOR IMAGE

BACKGROUND OF THE INVENTION

1. Field of the Invention

The present invention concerns a method of forming a reversible color image used in a display/recording apparatus, for example, for a hard copy or display, as well as a device for forming a reversible color image for practicing the method.

2. Description of the Related Art

There has been a great demand for color hard copies at a reduced cost and a heat sensitive full color recording system disclosed in Japanese Patent Laid-Open No. Hei 6-24020 (1994) has attained a practical level in recent years.

The system uses a heat sensitive color recording material having heat sensitive recording materials of three colors in lamination in which heat energy required for color formation is increased in the order of yellow, magenta and cyan and forms a full color hard copy by conducting (1) color formation only for yellow by low temperature heating thermal recording and exposure with a light at a first wavelength to fix yellow, (2) color formation only for magenta by medium temperature heating thermal recording and exposure with a light at a second wavelength to fix magenta and (3) color formation only for cyan by high temperature heating thermal recording, successively.

With the popularization of such a heat sensitive color recording system, it is expected that a demand will be increased for a reversible color image recording system capable of forming and erasing color repeatedly. In Japanese Patent Laid-Open No. Hei 6-79970 (1994) disclosing a reversible heat sensitive color recording medium and a reversible heat sensitive color recording system, there is described the constitution of a reversible heat sensitive color recording medium and a display medium, capable of easily conducting color formation and color erasure only by heating in a reversible heat sensitive recording medium and a display medium that utilize reaction between a color former and a developer, capable of stably maintaining the state of color formation and the state of color erasure at a normal temperature and having a color erasing temperature lower than a color forming temperature.

Description is to be made for the color image forming system with reference to FIG. 3 and FIG. 6. FIG. 3 is a constitutional view of a reversible heat sensitive color recording medium having a plurality of recording layers.

The reversible heat sensitive color recording medium 7 comprises a reversible heat sensitive recording layer 2A (forming color A), a reversible heat sensitive recording layer 2B (forming color B) and a reversible heat sensitive recording layer 2C (forming color C) having different tones of formed color and color erasure starting temperatures from each other and laminated on a support layer 1. An intermediate resin layer 3 is disposed between the recording layers and a protection layer 4 is formed at the upper surface. FIGS. 6A, 6B and 6C show a relationship between the color formation starting temperature and the color erasure starting temperature for each of reversible heat sensitive recording layers 2A, 2B and 2C. In FIG. 6, the abscissa indicates the temperature, while the ordinate indicates the color formation density.

In the drawings, each of the solid line curves indicates a density change when the temperature is raised from a color erased state. For example, in the recording layer 2A, the density rises at temperature TA1 and reaches a color-formed state at a temperature higher than that. The temperature TA1 is defined as the color formation starting temperature of the recording layer 2A. In the same manner, the color formation starting temperatures for the recording layers B and C are TB1 and TC1, respectively.

Further, each of the dotted curves in the drawings shows the change of the density when the temperature of the recording layer in the color-formed state is raised from the room temperature. For example, in the recording layer 2A, the density lowers abruptly at TA2 to erase color. The temperature TA2 is defined as the color erasure starting temperature of the recording layer 2A. For the recording layers B and C, the color erasure starting temperatures are TB2 and TC2 respectively. For the recording layers 2A, 2B and 2C, the color formation starting temperature and color erasure starting temperature are different from each other and the region indicated by an arrow between the color formation starting temperature and the color erasure starting temperature, namely, a color erasing temperature region is displaced between each of the recording layers 2A, 2B and 2C.

Description is to be made for the image forming system of forming each of colors by using the recording medium described above.

The color of the recording layer in the color-formed state can be erased by giving a temperature in the color erasing temperature region. Accordingly, when the recording medium 7 in which a color is formed is temporarily heated at temperature T2, temperature T3 and temperature T4, followed by cooling, respectively, colors are erased in the recording layer 2C at temperature T2, in the recording layer 2B at temperature T3 and in the recording layer 2A at temperature T4 respectively, so that the entire recording medium 7 turns colorless to attain initialization.

When the initialized recording medium 7 is heated temporarily to temperature T1 higher than the color formation starting temperature TC1 for the recording layer 2C followed by cooling, since color formation occurs not only in the recording layer 2C but also in the recording layers 2A and 2B, the recording medium 7 shows a mixed color of color A, color B and color C in three layers. That is, the mixed color of color A, color B and color C in the three layers can be obtained in the recording medium 7 by giving the temperature in the order of T2, T3, T4, T1.

When the initialized recording medium 7 is temporarily heated to temperature T2 higher than the color formation starting temperature TB1 for the recording layer 2B but lower than the color formation starting temperature TC1 for the recording layer 2C followed by cooling, color formation occurs in the recording layer 2B and the recording layer 2A, and the recording medium 7 shows a mixed color of color A and color B in two layers. That is, the color A and the color B in the two layers can be obtained in the recording medium 7 by giving the temperature in the order of T2, T3, T4, T2.

Further, when the recording medium 7 in which the mixed color in the three layers (A, B, C) is formed is temporarily heated to temperature T3 within the color erasing temperature region for the recording layer 2B (TA1<T3<TC2), followed by cooling, color erasure occurs in the recording layer 2B at temperature T3. However, since T3 is higher than the color formation starting temperature TA1 for the recording layer 2A and lower than the color erasure starting temperature TC2 for the recording layer 2C, no color erasure occurs in the recording layers 2A and 2C. Therefore, when the recording medium 7 in which the mixed color (A, B, C)

is formed is temporarily heated to temperature T3, a mixed color (A, C) is obtained. That is, the mixed color of color A and color C in the two layers can be obtained in the recording medium 7 by giving the temperature in the order of T2, T3, T4, T1, T3.

When the recording medium 7 in which the mixed color (A, B, C) in the three layers is formed is temporarily heated to temperature T4 within the color erasing temperature region for the recording layer 2A (T4<TB2), followed by cooling, color erasure occurs in the recording layer 2A at temperature T4. However, since T4 is lower than the color erasure starting temperatures TB2 and TC2 of the recording layers 2B and 2C, no color erasure occurs for the recording layers 2B and 2C. Accordingly, when the recording medium 7 in which the mixed color (A, B, C) is formed is temporarily heated to temperature T3, a mixed color (B, C) is obtained. That is, the mixed color of color B and color C in the two layers can be obtained in the recording medium 7 by giving the temperature in the order of T2, T3, T4, T1, T4.

Further, when the recording medium 7 in which the mixed color (A, C) is formed is temporarily heated to temperature T4 for the color erasing temperature region of the recording layer 2A (TA2<T4<TB2), followed by cooling, color erasure occurs only in the recording layer 2A and the recording layer 2C is kept as it is in the state of color formation, so that the color of the recording medium 7 is only the color of the recording color 2C. That is, the color C can be obtained for the recording layer 7 by giving the temperature in the order of T2, T3, T4, T1, T3, T4.

When the recording medium 7 in which a mixed color (A, B) is formed is temporarily heated to temperature T4 within the color erasing temperature region of the recording layer 2A (TA2<T4<TB2), followed by cooling, color erasure occurs only in the recording layer 2A and color formation is kept as it is for the recording layer 2B, so that the color of the recording medium 7 is the color only for the recording layer 2B. That is, the color B is obtained for the recording medium 7 by giving the temperature in the order of T2, T3, T4, T2, T4.

Further, when the initialized recording medium 7 is temporarily heated to temperature T3 higher than the color formation starting temperature TA1 for the recording layer 2A and lower than the color formation starting temperature TB1 for the recording layer 2B, followed by cooling, color is formed only for the recording layer 2A and the color of the recording medium 7 is color A. That is, the color A can be obtained in the recording medium 7 by giving the temperature in the order of T2, T3, T4, T3.

Accordingly, the relationship between the colors obtained and the temperature to be set successively for the method of forming the image is as shown in Table 1.

TABLE 1

| Color obtained | Step 1 | 2 | 3 | 4 | 5 | 6 | 7 |
|---|---|---|---|---|---|---|---|
| Initialization (colorless) | T2 → | T3 → | T4 | | | | |
| Mixed color (A, B, C) | T2 → | T3 → | T4 → | T1 | | | |
| Mixed color (A, B) | T2 → | T3 → | T4 | → | T2 | | |
| Mixed color (A, C) | T2 → | T3 → | T4 → | T1 | → | T3 | |
| Mixed color (B, C) | T2 → | T3 → | T4 → | T1 | | → | T4 |
| Mono-color (C) | T2 → | T3 → | T4 → | T1 | → | T3 → | T4 |
| Mono-color (B) | T2 → | T3 → | T4 | → | T2 | → | T4 |
| Mono-color (A) | T2 → | T3 → | T4 | | → | T3 | |
| Background (colorless) | T2 → | T3 → | T4 | | | | |
| | ↑ Entire color erasure | ↑ | ↑ | ↑ Imagewise color formation | ↑ | ↑ Formed/ erased color mixed | ↑ Color erasure |
| | | | | +A +B +C | +A +B | +A −B | −A |

In the foregoing explanation, the heating temperature means a temperature at which heating is conducted temporarily. For example, heating from temperature T1 to temperature T3 means that the medium is temporarily heated to temperature T1, followed by cooling and then temporarily heated to temperature T3, followed by cooling again.

As can be seen also in Table 1, for forming an image using all the colors, three steps for initialization and four steps for image formation, namely, 7 steps in all are necessary. The image forming device for this steps comprises three heat rollers for heating the entire surface of a reversible heat sensitive recording medium at temperatures different from each other, and three thermal heads for heating at temperatures different from each other corresponding to the pattern of the image.

Although explanation has been made in the foregoing example to a case where the reversible heat sensitive recording medium layer 2 comprises three layers, color recording can also be conducted in the same manner also in a case for two layers or four or more layers. In a case of the two layers, an image of three colors, that is, a mixed color and two mono-colors can be obtained. Images of seven colors are obtained in the three layers and images of 15 colors can be obtained in the four layers respectively. When the colors are erased in each of the color-formed recording layers successively from the recording layer 2 having higher color erasure starting temperature, to conduct color erasure for the entire color recording layers, initialized state can be attained. Further, the recording medium 7 can form the color image repeatedly by this procedures.

FIG. 12 shows a fundamental constitution of a recording device for forming an image by the image forming system described above for the recording medium 7 having three reversible recording layers as described above.

Heat generating bodies L1, L2 and L3 are initializing heat generating bodies for heating the recording layers 2A, 2B and 2C entirely to respective color erasing temperatures thereby conducting color erasure over the entire surface. The heat generating bodies H1, H2 and H3 are image forming heat generating bodies for imagewise heating each of the recording layers 2A, 2B and 2C. When the color erasure starting temperatures for the recording layers 2A, 2B and 2C of the recording medium 7 are as shown in FIG. 6, each of the heat generating bodies L1, L2 and L3 is set such that the recording layer 2 can be heated successively to temperatures T2, T3, T4 and, if a multi-color image has already been formed to the recording medium 7, color erasure is conducted for the entire recording layers 2 in the recording medium 7 by passing the medium through the portion.

Subsequently, the recording medium 7 passes through the image forming section comprising the heat generating bodies H1, H2 and H3 capable of applying heating imagewise to the recording medium 7. Among them, the heat generating body H1 is used for color formation which generates heat so as to apply heating imagewise as required to temperature T1, T2 or T3. Succeeding heat generating bodies H2 and H3 generate heat imagewise as required such that the recording layer 2 can be heated to temperatures T3 and T4 respectively, thereby erasing a desired color in the recording layer 2 that forms a color by heat generating body H1.

More specifically, if only the recording layer 2C in FIG. 3 is a necessary portion, it is set such that the heat generating body H1 can be heated to temperature T1 and the heat generating bodies H2 and H3 can be heated to temperatures T3 and T4 respectively. When the medium passes through the heat generating body H1, the entire recording layers 2A, 2B and 2C form colors, whereas the recording layer 2B erases color upon passage through the heat generating body H2 and the recording layer 2A erases color upon passage through the heat generating body H3, so that the image area has a color only of the recording layer 2C.

Table 2 collectively shows such steps of forming the image and image formation is conducted by at 6 steps of heating for color formation only of the recording layer 2C.

A series of this process is the same as that noted for the formation of the image region of the background (colorless) in for the image region of the mono-color (C) in Table 1. In step 1, 2, 3, 4, 6 or 7, heating to one of the regions is applied. On the other hand, at step 5, heating is applied to none of the steps. Accordingly, it requires six steps of heating.

TABLE 2

| | Heating device | Heating temperature | Heating region | Process |
|---|---|---|---|---|
| 1 | L1 | T2 | Entire surface | C layer initialized (C layer erased) |
| 2 | L2 | T3 | Entire surface | B layer initialized (B layer erased) |
| 3 | L3 | T4 | Entire surface | A layer initialized (A layer erased) |
| 4 | H1 | T1 | Imagewise (image area) | A, B, C layers image-formed (A, B, C layer image areas colored) |
| 5 | H2 | T3 | Entire surface | B layer initialized (B layer erased) |
| 6 | H3 | T4 | Entire surface | A layer initialized (A layer erased) |

However, in the image forming system of the prior art, since colors of a plurality kinds of reversible heat sensitive recording materials are successively erased for initialization by entirely heating the recording medium or the display medium to the color erasing temperatures of the plurality kinds of the reversible heat sensitive recording materials, a number of processes are necessary for initialization and the recording medium or the display medium has to be heated over and over during the process, to result in a drawback of requiring a long time for initialization and low efficiency from an energy point of view.

Further, since the method of forming the image on the recording medium or the display medium requires a process for erasing another color formed simultaneously after forming the image of a mono-color, it results in a problem that the image forming process is further complicated than the erasure and the efficiently is poor in view of time or energy.

Furthermore, since for conducting such complicate processes, it is necessary in the image forming device to provide a plurality of heating devices for heating the entire recording medium or display medium to color erasing temperatures respectively, it suffers from a drawback that the entire device is complicated in the constitution and enlarged in the scale.

SUMMARY OF THE INVENTION

The present invention has been accomplished in view of the foregoing situations and it is an object thereof to provide a method of forming a reversible color image having a high energy efficiency and capable of forming the color image in a simple and rapid process, as well as a device for forming a reversible color image which is smaller in size and simpler in constitution.

The foregoing object can be attained in accordance with a first aspect of the present invention by a method of forming a reversible multi-color image to a reversible heat sensitive color recording medium in which recording layers each containing independently a plurality kinds of reversible heat color forming compositions having tones of formed color and color erasure starting temperatures different from each other are formed on a support, said method comprising: heating the reversible heat sensitive color recording medium entirely thereby causing color formation to the plurality kinds of the reversible heat color forming compositions of the reversible heat sensitive color recording medium; and then heating an image area or non-image area so as to be in a color erasing temperature region of the reversible heat color forming composition and erasing the color of the image area or the non-image area thereby forming a multi-color image.

In a preferred mode of the above method of the present invention, the image area or the non-image area is heated, said image area or the non-image area is heated so as to be in the color erasing temperature region in the order from the reversible heat color forming composition having a higher color erasure starting temperature to the reversible heat color forming composition having a lower color erasure starting temperature among the plurality kinds of the reversible heat color forming compositions, and the color of the image area or the non-image area is erased, thereby forming the multi-color image.

In another preferred mode of the above device of the present invention, the color forming temperatures of the plurality kinds of the reversible heat color forming compositions are substantially identical with each other and, when the image area or the non-image area is heated, said image area or the non-image area is heated such that the color erasure starting temperature of the plurality kinds of the reversible heat color forming compositions are in the color erasing temperature region in the order from the reversible heat color forming composition having a higher color erasure starting temperature to the reversible heat color forming composition having a lower color erasure starting temperature.

In accordance with a second aspect of the present invention, there is provided a device for forming a reversible color image of forming a multi-color image to a reversible heat sensitive color recording medium in which recording layers each containing, independently, a plurality kinds of reversible heat color forming compositions having tones of formed color and color erasure starting temperatures different from each other are formed on a support, said device comprising: a first heating means of heating the reversible heat sensitive color recording medium entirely thereby causing color formation for the plurality kinds of reversible heat color forming compositions of the reversible heat sensitive color recording medium; and a second heating means of heating an image area or a non-image area to a color erasing temperature region of the reversible heat color forming composition.

In a preferred mode of the above device of the present invention, the heating temperature of the second heating means is a temperature in a color erasing temperature region of a reversible heat color forming composition having a higher color erasure starting temperature among the plurality kinds of reversible heat color forming compositions.

In another preferred mode of the above device of the present invention, the color forming temperatures of the plurality kinds of the reversible heat color forming compositions are substantially identical with each other, and the heating temperature of the second heating means is a temperature in a color erasing temperature region of a reversible heat color forming composition having a lower color erasure starting temperature among the plurality kinds of reversible heat color forming compositions.

Namely, in the method according to the present invention, an image area is formed by heating to erase the color for a non-image area (non-imagewise) for at least one kind of the compositions among the compositions forming color over the entire surface (initial state) for all the reversible heat sensitive color recording media.

In accordance with the present invention, in the method compositions having tones of formed color and color erasure starting temperatures different from each other are present on a support each in a separated and independent state, since all the reversible heat sensitive color recording media are at first is heated over the entire surface to cause color formation, thereby obtaining an initialized state and then heating is applied not imagewise at temperatures different from each other successively, thereby erasing the colors of the plurality kinds of reversible thermally color forming compositions to form images respectively, color images can be formed by a process by a simple and rapid process at high energy efficiency.

Further, heating is temporarily applied to a color forming temperature region of a composition having the highest color forming among the color-formed reversible thermally color forming compositions contained in the reversible heat sensitive color recording medium or display medium having the formed color image thereby enabling the entire reversible thermally color forming compositions to put to a state of color formation to attain initialization, so that the color image can be initialized by a simple and rapid process at high energy efficiency.

Further, when the temperature regions between the color formation starting temperature and the color erasure starting temperatures are different respectively among the plurality kinds of reversible thermally color forming compositions, if heating is applied non-imagewise successively at different temperatures from the higher color erasure starting temperatures, combination of mono-colors and a mixed color can be obtained for a plurality kinds of reversible thermally color forming compositions.

Further, when the color formation starting temperatures are substantially identical among each of the plurality kinds of reversible thermally color forming compositions, if heating is applied not imagewise successively at different temperatures from the lower color erasure starting temperature, a combination of mono-colors and a mixed color for the plurality kinds of reversible thermally color forming compositions can be obtained.

DESCRIPTION OF THE PREFERRED EMBODIMENTS

Explanation is to be made for a preferred embodiment according to the present invention with reference to the drawings.

A reversible heat sensitive color recording medium 7 and a display medium (hereinafter, the recording medium includes the display medium) used in this embodiment is formed by laminating two or more recording layers each containing a developer and a color former (three layers of recording layer 2A, recording layer 2B and recording layer 2C in the example shown in FIG. 3). Further, the medium may comprise such a structure as shown in FIG. 4 obtained by providing a plurality kinds of compositions having tones of formed color and color erasure starting temperatures different from each other, preparing a plurality kinds of microcapsules 5 each containing the composition independently, forming each of capsule-containing recording layers 2A', 2B' and 2C' with the plurality kinds of microcapsules 5A, 5B and 5C and laminating the layers.

Figure 4:
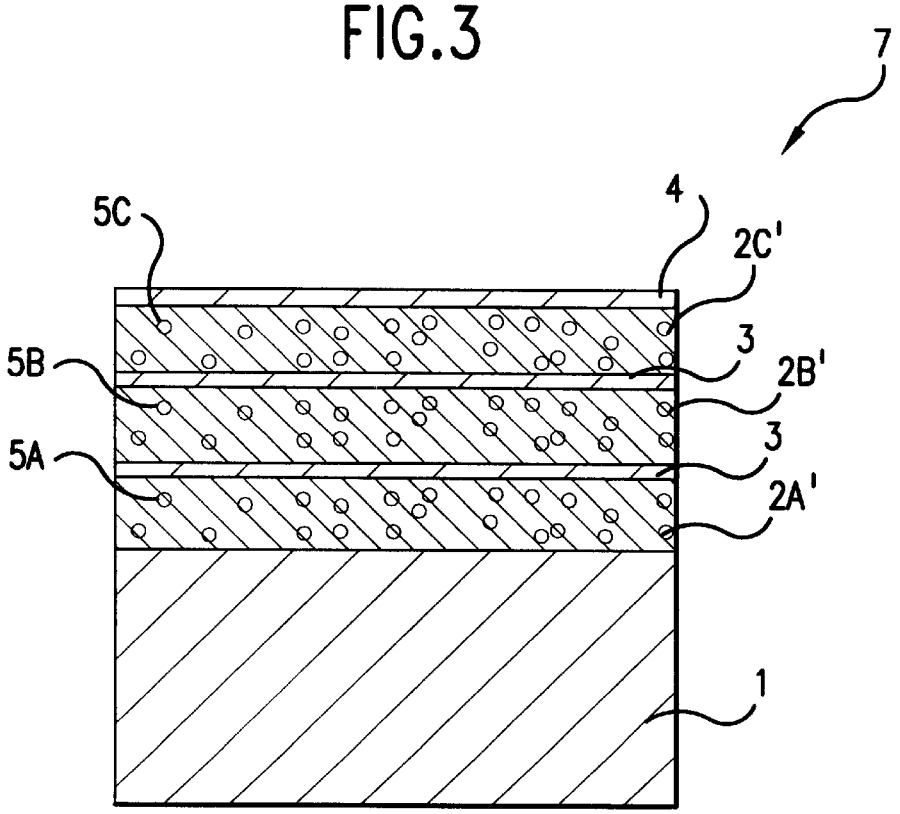
FIG. 4 is an explanatory cross sectional view illustrating the constitution of a reversible heat sensitive color recording medium.
Figure 5A:
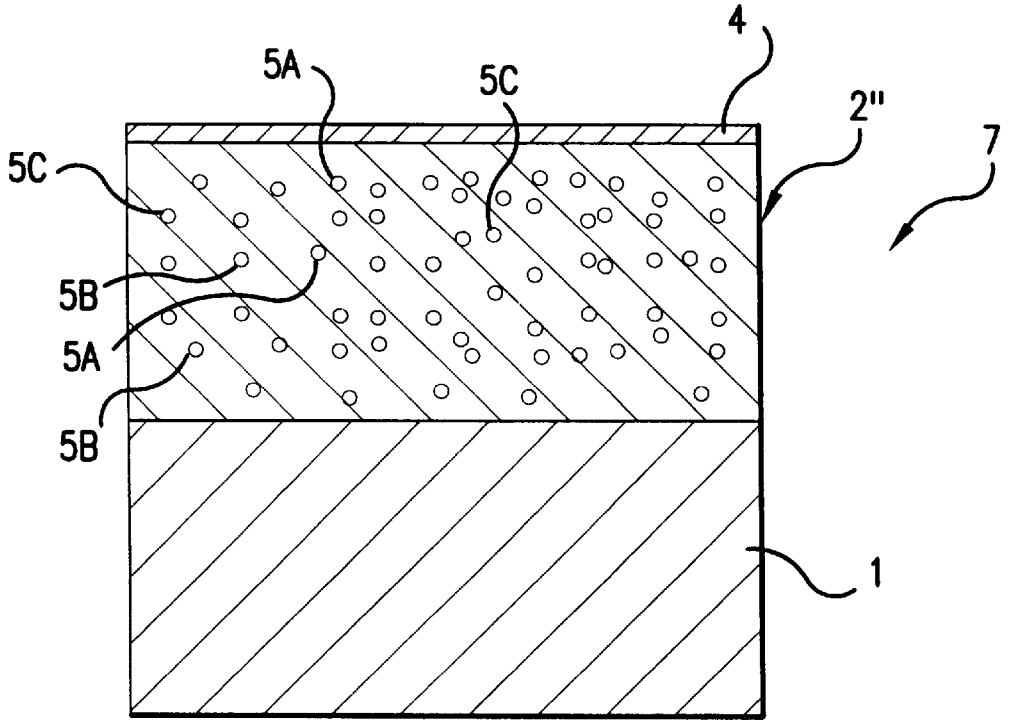
FIG. 5 is an explanatory cross sectional view illustrating the constitution of a single layer reversible heat sensitive color recording medium.
FIG. 5B is an explanatory cross sectional view illustrating a multi-layer reversible heat sensitive color recording medium.
Figure 5B:
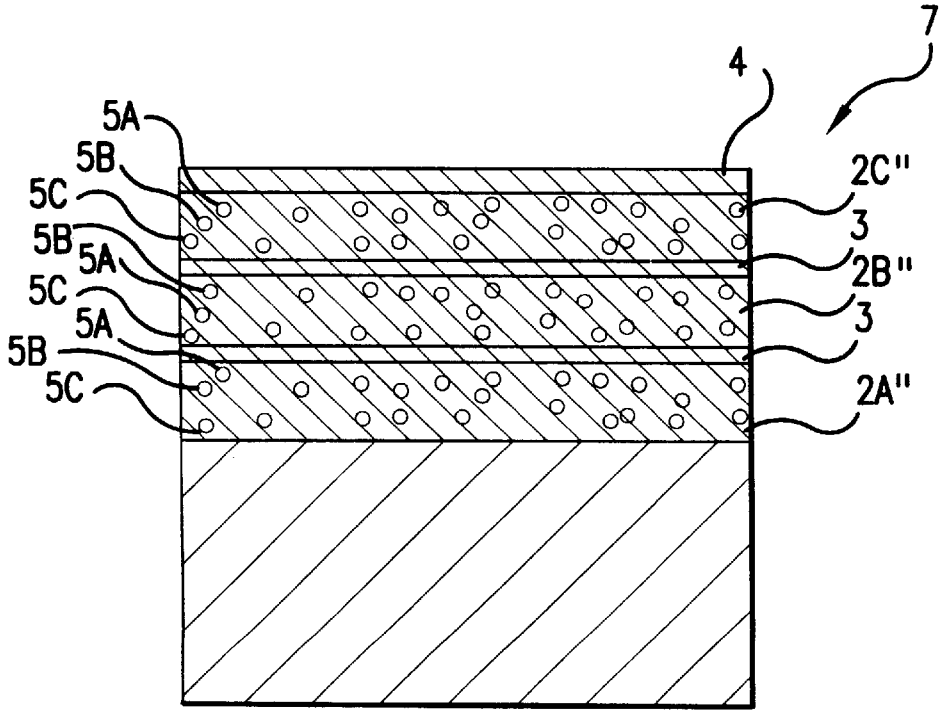

Further, a mixture of a plurality kinds of microcapsules may be incorporated into one recording layer, as shown in FIG. 5A thereby serving one capsule-containing recording layer 2" containing the plurality kinds of microcapsules 5A, 5B and 5C also as each of the recording layers 2A', 2B' and 2C' described above. In FIG. 4, FIG. 5A, and FIG. 5B, parts or portions identical with those shown in FIG. 3 carry the same reference numerals.

Further, as shown in FIG. 5B, a plurality of layers 2A", 2B", and 2C" can be formed by a method forming a reversible multi-color image to a reversible heat sensitive color recording medium in which recording layers 2A", 2B" and 2C" each contain a plurality of kinds of reversible heat color forming compositions 5A, 5B and 5C having tones of formed color and color erasure starting temperatures different from each other.

Each of the recording layers 2A, 2B and 2C, or the plurality kinds of microcapsules 5A, 5B and 5C in the recording medium 7 have tones of formed color and color erasure starting temperatures different from each other. Accordingly, when heating is applied to the recording layers 2 at a temperature higher than the color forming temperature for the entire recording layers 2, an image of a mixed color obtained by color formation of the entire recording layers 2 or the entire microcapsules 5 is obtained and, when heating is applied to the mixed color image for the identical image area at a predetermined erasing temperature, a mixed color or mono-color image from which the color of the recording layer 2 or the microcapsule 5 corresponding to the color erasing temperature is erased is obtained. When such procedures are repeated, an optional mono-color or mixed color image constituting each of the recording layers 2 can be obtained in the recording medium 7.

Further, color formation may be conducted not reversibly to a portion of the recording layer 2 or the microcapsule 5 constituting the reversible heat sensitive color recording medium 7. However, since the once formed color of the nonreversible recording layer or the microcapsule in this case can not be erased, it is present merely as the background color in the recording medium.

Further, the recording medium 7 may contain a nonreversible thermally color forming composition (thermally color forming composition having a color erasing temperature higher than a color forming temperature or not having any color erasing temperature and, thus, difficult for color erasure).

In the reversible heat sensitive color recording medium 7, the developer used in combination with the color former is a compound basically having a structure showing a developing performance capable of causing the color former to form color and having an alkyl chain structure for controlling the intermolecular coercive force together in the molecule. The developer includes, for example, an organic phosphate compound, aliphatic carboxylic acid compound or phenol compound having 12 or more carbon atoms, metal salt of mercapto acetic acid having an aliphatic group of 10 to 18 carbon atoms, or alkyl ester of caffeic acid having an alkyl group of 5 to 8 carbon atoms. The aliphatic group includes a chained or branched alkyl or alkenyl group which may have a substituent such as halogen, alkoxy or ester group.

The color forming composition is formed basically by the combination of the developer and the color former. The color former used in this embodiment exhibits electron donating property which is colorless or mono-color dye precursor by itself, and known compounds, for example, triphenyl methane phthalide type compound, fluorane type compound, phenothiazine type compound, leuco-auramine type compound and indolinophthalide type compound may be used.

The ratio between the color former and the developer contained in the composition has to be selected to an appropriate ratio depending on the physical properties of the compound used. The range of the developer per one mol of the color former is from 1 to 20 and, preferably, from 2 to 10 mols. Each of the developer and the color former may be used alone or as a mixture of two or more of them. Color erasing property changes depending on the ratio of the developer to the color former such that color erasure starting temperature is lower as the ratio of the developer is relatively higher, whereas color erasure becomes sharp relative to the temperature as the ratio of the developer is relatively smaller. Accordingly, the ratio may be selected properly depending on the application use and the purpose. The color forming composition used in the embodiment basically comprises the developer and the color former described above. Further, an additive having an effect of controlling crystallization of the developer or the like may be incorporated for improving various characteristics, for example, color erasing property or preserving property.

For obtaining the color recording medium 7 by providing a plurality of reversible heat sensitive recording layers 2, the plurality of reversible heat sensitive recording layers each containing only one kind of the thermally color forming composition may be laminated on a support 1. However, it is more preferred to dispose an intermediate resin layer 3 between laminated recording layers 2. The intermediate resin layer 3 used herein is for preventing fusion-mixing between each of the recording layers during heating and is preferably formed with a heat resistant resin.

Further, the support 1 may be composed any of paper, synthetic paper, a plastic film, a composite member thereof, a glass plate so long as it can be maintained in the recording layer 2. The reversible heat sensitive recording layer may be in any of forms providing that the thermally color forming composition is present. For example, the developer and the color former may be mixed and melted into a film, which is then cooled to form a reversible heat sensitive recording layer. However, it is usually preferred to disperse the developer and the color former sufficiently in a binder resin to form a reversible heat sensitive recording layer, and a long life reversible heat sensitive color recording medium can be obtained by this method.

As the binder resin, there can be used, for example, hydroxyethyl cellulose, hydroxypropyl cellulose, methoxy cellulose, carboxymethyl cellulose, methyl cellulose, acetic acid cellulose, gelatin, casein, starch, sodium polyacrylate, polyvinyl pyrrolidone, polyacryl amide, polyvinyl chloride, polyvinyl acetate, vinyl chloride-vinyl acetate copolymer, polystyrene, styrenic copolymer, phenoxy resin, polyester, aromatic polyester, polyurethane, polycarbonate, polyacrylate, polymethacrylate, acrylic acid copolymer, maleic acid copolymer, polyvinyl alcohol, vinyl chloride resin or a mixture of such resins.

The developer and the color former may be used as they are or being incorporated in microcapsule. The developer and the color former can be micro-encapsulated by a known method such as a coacervation method, an interface polymerization method or an in situ polymerization method. The reversible heat recording layer can be formed in accordance with the known method, by dispersing or dissolving the color former and the developer together with a binder resin in water or organic solvent homogeneously, and coating and drying the same on the support 1 or on the intermediate resin layer 3.

The binder resin in the reversible heat sensitive recording layer has a function of preventing coagulation of the thermally color forming composition by repeated color formation and color erasure and maintaining a state in which the thermally color forming composition is dispersed uniformly. Particularly, since the thermally color forming composition often coagulates to become inhomogeneous by the application of heat upon color formation, it is desirable that the binder resin has a high heat resistance.

In the reversible heat sensitive color recording medium 7 described above, various additives used in usual heat sensitive recording paper, for example, a dispersant, surfactant, high molecular cationic electroconductive agent, filler, color-formed image stabilizer, antioxidant and light stabilizer may be added with an aim of improving the coating property or the recording property as required.

The intermediate resin layer 3 is a separation layer for preventing adjacent reversible heat sensitive recording layers 2 from mixing by heat/pressure upon color erasure or formation. The reversible heat sensitive color recording medium 7 has a plurality of reversible heat sensitive recording layers 2 for making a multi-color arrangement. In a case where an identical resin is used as the binder resin in each of the layers constituting the recording layer 2, it is recognized that the adjacent recording layers 2 tend to be mixed partially by pressure/heat upon application of heating. The problem can be solved by disposing the intermediate resin layer 3.

The intermediate resin layer 3 can be formed by coating a resin which is not or less soluble with the binder resin in the adjacent recording layers 2 or a resin not soluble at the recording temperature on the recording layer 2. If the recording layer 2 is formed with a coating solution containing an organic solvent, the intermediate resin layer 3 is preferably formed by using a water soluble resin coating solution containing an aqueous solvent.

Further, the intermediate resin layer 3 may also be formed by appending a heat resistant resin film on the recording layer 2 and it is particularly preferred to form the resin film by adhesion using a dry lamination process, with an aim of improving the color forming property or image storability of the recording medium 7.

As the resin film for forming the intermediate layer, a polyester film such as polyethylene terephthalate is preferably used. Further, films such as made of polyamide, polyimide, polyamideimide or polyparaffinic acid can also be used preferably. As the adhesive used for the adhesion of the resin film, any of adhesives used for the dry lamination can be used, for example, a thermoplastic resin such as ionomer resin, acrylic resin (also including aqueous emulsion), modified ethylene-polyvinyl acetate copolymer, polybutadiene, phenoxy resin, polyvinyl ether, polyvinyl formal, vinyl acetate resin and polyester. The thickness of the intermediate resin layer may be such that the layer does not suffer from destruction by the application of heat and pressure during repeating recording/erasing. However, since the heat conductivity is reduced if the thickness of the intermediate resin layer is excessive, the layer is desirably as thin as possible and it is usually preferred to be 10 $\mu$m or more.

The recording medium shown in FIGS. 5A and 5B is prepared by micro-encapsulating each of compositions having tones of formed color and color erasure starting temperatures different from each other and forming a mixture of them on the support 1. That is, the recording medium is formed by preparing a mixture of several kinds of microcapsules 5 each containing, independently, compositions having tones of formed color and color erasure starting temperatures different from each other and coating the mixture on the support 1. As the resin for forming microcapsule walls, a known thermoplastic or thermosetting resin may be used. As the binder resin used for coating the microcapsules 5 on the support 1, a usual heat resistant resin for forming the recording layer may be used, for which various kinds of binder resins described above can be used. Further, for improving the thermal and mechanical strength of the recording layer 2" containing the microcapsules 5, a method of using a thermosetting resin as the binder resin for the recording layer 2" and setting the resin after disposition is suitable as a method of disposing the recording layer 2".

A protection layer 4 is formed on the surface of the reversible heat sensitive color recording medium 7, as shown in FIG. 3 to FIG. 5B. The protection layer 4 has a function of preventing the surface from deformation or discoloration by heat and pressure upon applying heating, as well as improving, for example, chemical resistance, water proofness, friction resistance and head matching property. As the material for forming the protection layer 4, it is preferred to use a resin film which is heat resistant and has large strength, and a polyamide film, polyimide film, aromatic polyester film or polyparabanic acid film may be used.

Formation of such a protection layer 4 can improve the heat resistance, as well as increase resistance against contact with organic solvent, plasticizer, oil, sweat and water, and a recording medium 7 capable of repeating image formation and erasure with no troubles even under deteriorated circumstance can be obtained. Further, a recording medium remarkably improved with light fastness of images and background can be obtained by incorporating a light stabilizer in the protection layer 4, addition of a high molecular cationic electroconductive agent enables to provide antistatic property, and incorporation of organic or inorganic filler and lubricant in the protection layer 4 can provide a heat sensitive recording medium 7 of excellent reliability and head matching property with no trouble of sticking caused by contact with a thermal head.

Further, in the reversible heat sensitive color recording medium 7, an undercoat layer (not illustrated) may be disposed as necessary between the support 1 and the recording layer 2. The undercoat layer is disposed with aims of improving the heat insulation property, improving the adhesion between the support 1 and the recording layer 2, improving the resistivity of the support 1 against a solvent upon preparation of the recording layer 2, inhibiting absorption of thermo-melting ink to the support 1 by heat application and the like and the necessity for the provision of the undercoat layer may be determined depending on the kind of the support 1. One of the important roles of the undercoat layer is an improvement for the heat insulation property, which contributes to thermal formation or thermal erasure of recording with no energy loss of heat application, and color formation and color erasure can be conducted sharply by the deposition of the heat insulation layer.

The undercoat layer with an aim of heat insulation can be formed by coating minute hollow particles each made of an organic or inorganic material and containing air at the inside on the support 1 and, more specifically, minute hollow members with a grain size of about 10 to 15 $\mu$m formed with glass, ceramics or plastics may be dispersed thoroughly together with the binder resin into the solvent and coated uniformly and dried on the support.

The reversible heat sensitive color recording medium 7 can be prepared by various procedures and, for example, the medium can be prepared by coating the recording layer 2A on the support 1, laminating thereon a resin film coated with an adhesive (intermediate resin layer 3), then coating the recording layer 2B and laminating the resin film. Further, in the lamination method, the films are pressed and heated by a heat roller or the like after appending and bonded firmly. The pressing/heating may be applied after appending the entire layers including the protection layer 4, or may be applied on every formation of each intermediate resin layer 3.

Further, the recording layer 2" can also be formed by coating various types of micro-encapsulated compositions having tones for formed color and color erasure starting temperatures different from each other on the support 1 (FIG. 5A). Further, it is also possible to form at least one layer in the lamination of a plurality of recording layers 2 as a microcapsule-containing layer and form the other layers as usual thermally color forming composition containing layers.

In the embodiment described above, a transparent recording medium can be obtained by using a transparent film on the support 1, which is used as the display medium. In this case, it will be apparent that a film of high transparency is preferred used for the intermediate resin layer 3 and the protection layer 4.

Then, description is to be made for the method of forming an image in the reversible heat sensitive color recording medium 7.

The reversible heat sensitive color recording medium 7 can be initialized by being temporarily heated to a temperature at which all the reversible thermally color forming compositions contained in each of the recording layers 2 of the recording medium 7 form colors. The recording image can be formed by using, for example, a thermal pen, thermal head or laser heating depending on the purpose of use. In the same manner, the recording image can be erased by using a heating roller, planar heat generating body, thermostable bath, hot blow or thermal head capable of providing a temperature condition for erasure.

A color image forming recording device for forming an image on the reversible heat sensitive color recording medium 7 comprises a heat generating body for image recording capable of applying heat imagewise such that an optional composition among a plurality kinds of compositions is raised to a color erasing temperature thereof, and a heat generating body for initialization capable of applying heat to all the compositions entirely to color forming temperatures thereof. In this case, each of the heat generating bodies comprises a group of heat generating bodies composed of a plurality of heat generating bodies or one heat generating body having a temperature controllable mechanism.

Figure 1:
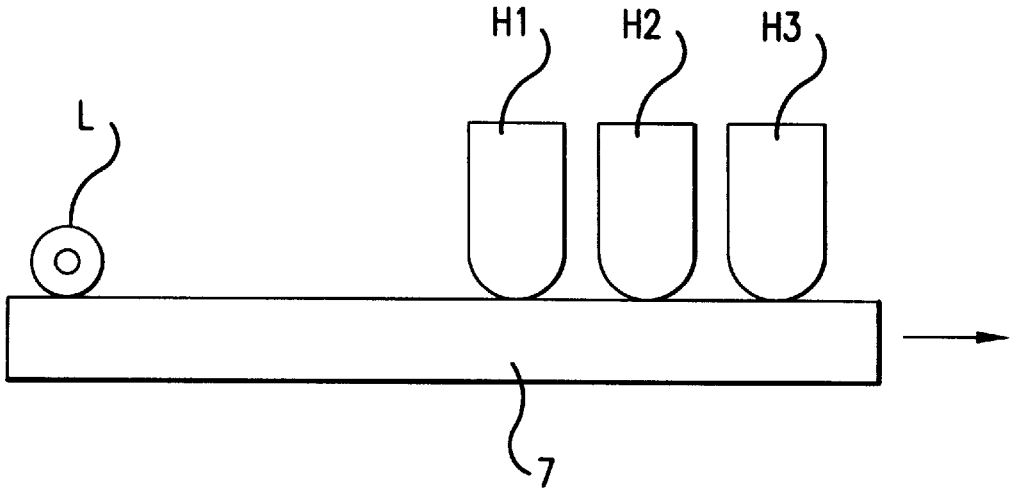
FIG. 1 is an explanatory constitutional view illustrating a basic constitution of a device for forming an image in one embodiment according to the present invention.

FIG. 1 shows a fundamental constitution of the recording device for the recording medium 7 having three reversible recording layers 2. A heat generating body L for initialization is a heat generating body for entirely heating all the recording layers 2 of the recording medium 7 to the color forming temperatures thereof to cause color formation, heat generating bodies H1, H2 and H3 for image recording are heat generating bodies for imagewise heating each of the recording layers 2. As the heat generating bodies H1, H2 and H3 for image recording, usual thermal heads for thermal recording are used since it is necessary to apply heating imagewise, whereas a heat roller or thermal head can be used as the heat generating body L for initialization since it may suffice to heat the entire area (entire surface).

Since the reversible thermally color forming composition of the recording medium 7 comprises an electron donating coloring compound and an electron accepting coloring compound, color can be formed instantaneously by heating, and the state of color formation exists stably even at a normal temperature. On the other hand, the composition in the state of color formation can be erased by heating to a color erasing temperature lower than the color forming temperature and the state of color erasure exists stably even at a normal temperature.

Figure 2:
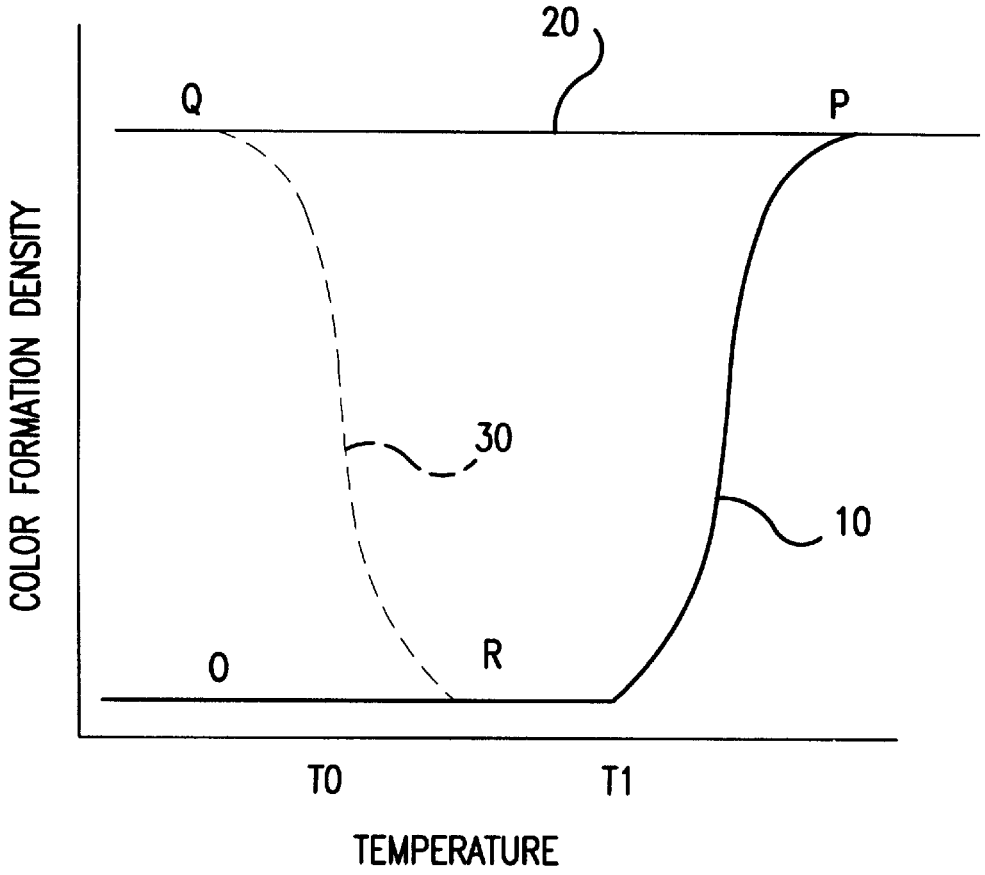
FIG. 2 is a view showing a relationship between the color formation density and the temperature for the composition of a recording medium.

Description is to be made for the color formation and color erasure of the reversible thermally color forming composition of the recording medium 7 (hereinafter simply referred to as a composition), that is, a principle for image formation and image erasure with reference to the graph shown in FIG. 2. In the graph, the ordinate indicates the color forming density while the abscissa indicates the temperature. The solid line 10 shows a image forming process by heating, while the dotted line 30 shows an image erasing process by heating.

The portion shown by the solid line 10 represents the density at the completely erased state, the portion P of the solid line 10 shows the density in a state of saturated color formation when heated to a temperature higher than T1, the portion C of the solid line 20 indicates the density at a temperature lower than T0 for the state of saturated color formation, and the portion D of the dotted line 30 indicates the density when heated and erased at a temperature between T0 and T1.

The composition is in a colorless state (portion O) at a temperature lower than T0. An image can be formed by heating to a temperature higher than T1 by a thermal head or the like, in which the composition causes color formation to form the image (portion P). If the image is returned to a temperature lower than T0 along with the solid line 20, it maintains the state as it is (portion Q) and the memory state of the recording is not lost.

Then, the image can be erased by heating the color formed composition to a temperature between T0 and T1 lower than the color forming temperature, in which the composition returns to the colorless state (portion R). This state is maintained as colorless (portion O) even if it is returned to a temperature lower than T0.

The course of forming the color-formed portion traces along the solid line OPQ to reach the portion Q where the image is maintained. The course of erasing the color formed portion traces the route of the dotted line QRO to reach the portion O in which the erased state is maintained. The behavior of forming and erasing the color formed portion is reversible and color formation and erasure can be repeated over and over.

Color formation of the composition used in the embodiment can be obtained by cooling to a room temperature a color formed composition formed through melting reaction of the developer and the color former by heating. Since the color formed composition has a color erasing temperature in an area lower than the melting temperature, rapid cooling is generally employed preferably for cooling from the molten color formed state into a normal temperature while maintaining color formation. In gradual cooling, color erasure is taken place when passing through the color erasing temperature region to often lower the density. It is considered that the color formed composition causes color formation by intermolecular action between the color former and the developer to open the lacton ring of the color former. The color formed composition cooled rapidly from the molten state contains developer molecules and color former molecules not directly concerned with the formation of a color-formed body in addition to color-body molecules. The color formed body composition at the normal temperature is in a state where coercive force is exerted between the molecules. The color formed composition is in the coagulated solid as described above. The coagulated structure described above shows a regularity, and the degree of the regularity may be extremely high or not so high depending on the case, which depends on the combination and the ratio of the quantity between the developer and the color former, cooling condition or the like.

It is estimated that a coercive force basically exerting between the alkyl chain structure portion of developer molecules forming the color formed body and the alkyl chain structure portion of the excessive developer molecules not forming the color formed body mainly acts on the formation of the coagulated structure. Formation of such a coagulated structure has a concern with the color erasing phenomenon of the color formed body composition. The color of the color formed body composition can be eased by heating to a predetermined temperature region. It is confirmed by way of X-ray analysis that the coagulated structure of the color formed body composition changes in the course of color erasure and, finally, the developer molecules are separated and crystallized from the color formed body to form crystals of the developer alone to reach a stable color erased state.

In the composition used in this embodiment, the alkyl group of the developer has a remarkable function in the course of forming the color formed body and the color erasure thereof. Therefore, the color forming and erasing temperatures shift on a higher temperature area depending on the length of the alkyl chain of the developer. This is because the coercive property or the moving property of the developer molecules change depending on the length of the alkyl chain portion. The reversible thermally color forming composition used in this embodiment is basically a composition comprising a combination of the developer having the alkyl chain structure and the color former, in which a preferred color former is present to the developer. Combination of the developer and the color former constituting the reversible thermally color forming composition is selected properly depending on the characteristics such as easy color erasure that occurs upon heating the composition in the color formed state obtained by heating both of the agents to a temperature higher than the melting temperature is heated to a temperature lower than the melting temperature, that is, the color erasing property, the tone in the state of the color formation or the like.

Among them, the color erasing property can be judged depending on the absence or the presence of a heat generation peak appearing in the course of the temperature elevation in differential thermal analysis (DTA) or differential scanning calorimetric analysis (ESD) for the composition in a color formed state obtained by the combination thereof. The heat generating peak corresponds to the color erasing phenomenon characterizing the composition, which gives a criterion for selecting a combination of preferred color erasing property. A third material may be present in the composition and, for example, the reversible color erasing/forming behavior can be maintained even if a high molecular compound is present.

Figure 6:
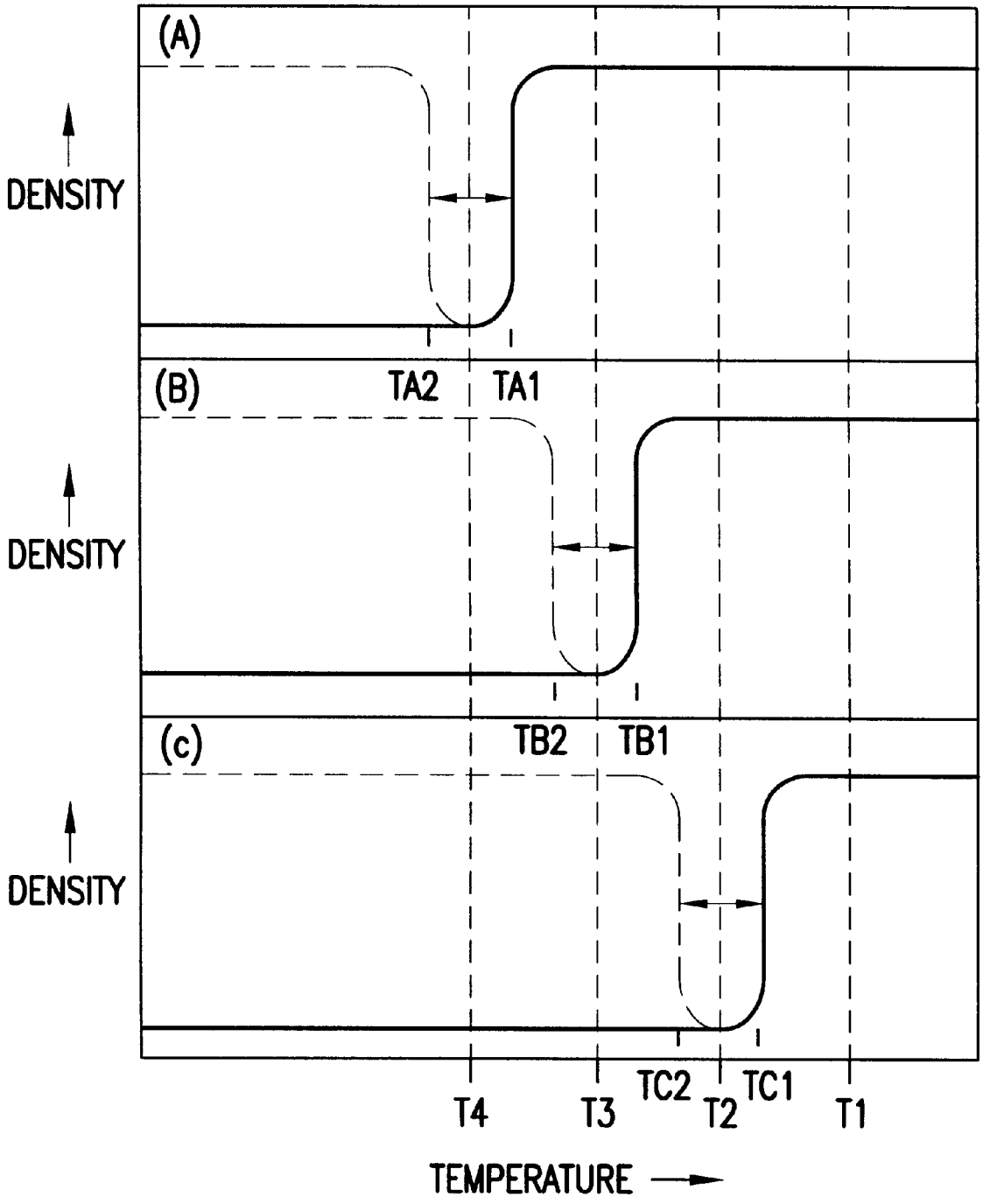
FIGS. 6A, 6B and 6C are views showing a relationship between the density and the temperature of each of the layers constituting the recording layers of the reversible heat sensitive color recording medium.

Then, the mechanism of forming a color image according to the present invention will be explained with reference to FIG. 3 and FIG. 6. FIG. 3 is a fundamental constitutional view of a reversible heat sensitive color recording medium 7 having a plurality of recording layers 2, in which the tone for formed color and the color erasure starting temperature of each of the recording layers 2A, 2B and 2C in the recording medium are different from each other, and FIGS. 6A, 6B and 6C show the relationship between the color formation starting temperature and the color erasure starting temperature. In FIG. 6, the abscissa indicates the temperature and the ordinate represents the density of the formed color.

In the drawing, the solid line shows the density change when the temperature is elevated from the color erased state. For example, in the color recording layer 2A, the density rises at temperature TA1 and attains the state of color formation at or higher than temperature TA1. TA1 is defined as the color formation starting temperature for the recording layer 2A. In the same manner, the color formation starting temperatures for the recording layers 2B and 2C are TB1 and TC1. Further, the chained line in the drawing shows the density change when the temperature of the recording layer in the state of color formation is elevated from the room temperature. For example, in the recording layer 2A, the density lowers abruptly to erase color at TA2. TA2 is defined as the color erasure starting temperature of the recording layer 2.

For the recording layers 2B and 2C, in the same manner, TB2 and TC2 are color erasure starting temperature. The color formation starting temperature and the color erasure starting temperature of the recording layers 2A, 2B and 2C are different from each other, and the regions shown by the arrows between the color formation starting temperatures and the color erasure starting temperatures, namely, the color erasure starting temperatures are displaced between each of the recording layers 2.

Then, explanation is to be made for the recording method, for example, to the recording medium 7 comprising three reversible heat sensitive recording layers having color formation starting temperatures and color erasure starting temperatures shown in FIG. 6.

For the color erasure starting temperature for each of the layers, it can seen from FIGS. 6A, 6B and 6C that the starting temperature is lowest for the recording layer 2*a*, the starting temperature is highest for the recording layer 2C and starting temperature for the recording layer 2B is between them. In the initial state, the medium is heated to temperature T1 in which each of the recording layers 2A, 2B and 2C causes color formation (mixed color). That is, a mixed color of color A, color B and color C can be obtained in the recording medium 7 by giving temperature T1.

When the initialized recording medium 7 (forming a mixed color (A, B, C)) is temporarily heated to temperature T2 within the color erasing temperature region for the recording layer 2C (TB1<T2), followed by cooling, the color of the recording layer 2C is erased at temperature T2. However, since temperature T2 is higher than the color formation starting temperature TB1 for the recording layer 2B and higher than the color formation starting temperature TA1 for the recording layer 2A, colors of the recording layers 2A and 2B are not erased. That is, a mixed color of color A and color B can be obtained in the recording medium 7 by giving temperature in the order of T1, T2.

Accordingly, an image of an optional shape can be obtained to the recording layer 2C by forming a region elevated to temperature T2 as a desired pattern on the recording medium 7 by a thermal head or the like.

In the same manner, when the initialized recording medium 7 (forming a mixed color (A, B, C)) is temporarily heated to temperature T3 (TA1<T3<TC2) within a color erasing temperature region of the recording layer 2B, followed by cooling, the color of the recording layer 2B is erased at temperature T3. However, no color change is caused to the recording layers 2A and 2C. That is, a mixed color A and color C can be obtained in the recording medium 7 by giving the temperature in the order of T1, T3.

Accordingly, an image of an optional shape can be obtained to the recording layer 2B by forming a region heated to temperature T3 as a desired pattern on the recording medium 7 by a thermal head or the like.

In the same manner, when the initialized recording medium 7 (forming a mixed color (A,B,C)) is temporarily heated to temperature T4 (T4<TB2) in a color erasing temperature region of the recording layer 2A, followed by cooling, although the color of the recording layer 2A is erased at temperature T4, no color change is caused to the recording layers 2B and 2C at temperature T4. That is, a mixed color of color B and color C can be obtained in the recording medium 7 by giving temperature in the order of T1, T4.

Accordingly, an image of an optional shape can be obtained to the recording layer 2A by forming a region heated to temperature T4 as a desired pattern by a thermal head or the like on the recording medium 7.

Then, when the recording medium 7 forming a mixed color A, C is temporarily heated to temperature T4 (T4<TB2) in a color erasing temperature region of the recording layer 2A, followed by cooling, since the color of the recording layer 2A is erased at temperature T4, only the color for the recording layer 2C remains. That is, color C can be obtained in the recording medium 7 by giving temperature in the order of T1, T3, T4.

When the recording medium 7 forming a mixed color A, B is temporarily heated to temperature T4 (T4<TB2) in a color erasing temperature region of the recording layer 2A followed by cooling, since the color of the recording layer 2A is erased at temperature T4, only the color for the recording layer 2B remains. That is, color B can be obtained in the recording medium 7 by giving temperature in the order of T1, T2, T4.

When the recording medium 7 forming a mixed color A, B is temporarily heated to temperature T3 (TA1<T3<TC2) in a color erasing temperature region of the recording layer 2B followed by cooling, since the color of the recording layer 2B is erased at temperature T3, only the color for the recording layer 2A remain. That is, color A can be obtained in the recording medium 7 by giving temperature in the order of T1, T2, T3.

Further, when the initialized recording medium 7 (forming mixed color (A, B, C)) is temporarily heated to temperature T2 (TB1<T2) in a color erasing temperature region of the recording layer 2C followed by cooling, then temporarily heated to temperature T3 (TA1<T3<TC2) in a color erasing temperature region of the recording layer 2B followed by cooling and, further, temporarily heated to temperature T4 (T4<TB2) in a color erasing temperature region of the recording layer 2A followed by cooling, since the color of the recording layer 2C is erased at temperature T2, the color of the recording layer 2B is erased at temperature T3 and the color of the recording layer 2A is erased at temperature T4, the recording medium 7 turns colorless. That is, the recording medium 7 can be formed into colorless by giving temperature in the order of T1, T2, T3, T4.

In the manner as described above, a desired image pattern can be formed to each of the recording layers 2A, 2B and 2C. This enables to form a desired color image by each of colors and mixed colors for color A, color B and color C. Table 3 shows the relationship between the colors obtained by the image forming method and the setting temperature set successively.

According to Table 3, image formation for causing only the recording layer 2C to form color is conducted by four step heating. This requires any of steps 1,2,3 and 4 for forming the mono-color and the background (colorless) simultaneously. As a result, it can be seen that remarkable saving can be obtained for steps, time and energy, whereas six steps of heating are required in a case of forming images by color formation

TABLE 3

| Color obtained | Step | 1 | 2 | 3 | 4 |
|---|---|---|---|---|---|
| Mixed color (A, B, C) | | T1 (Initialization) | | | |
| Mixed color (A, B) | | T1 → | T2 | | |
| Mixed color (A, C) | | T1 | → | T3 | |
| Mixed color (B, C) | | T1 | | → | T4 |
| Mono-color (C) | | T1 | → | T3 → | T4 |
| Mono-color (B) | | T1 → | T2 | → | T4 |
| Mono-color (A) | | T1 → | T2 → | T3 | |
| Background (colorless) | | T1 → | T2 → | T3 → | T4 |
| | Color formation for entire surface | | Color erasure for non-image area −C | Color erasure for non-image area −B | Color erasure for non-image area −A |

only for the recording layer 2C in the prior art method (refer to Table 1).

Further, according to the method of forming the image in the above-mentioned embodiment, it is simultaneously possible to form images for all the colors as a combination of A, B and C obtained by four steps of heating in the prior art (mixed color and mono-color).

In the embodiment described above, although explanations have been made to a case of three reversible heat recording layers 2, color recording can be conducted in the same manner also in a case of two layers, or four or more layers. In a case of the two layers, a three color image is possible for a mixed color and mono-colors, while seven color images are obtained from three layers and 15 color images are obtained from four layers.

In any of the cases, all the recording layers 2 take place color formation to form a mixed color in the initial state by temporarily heating to a temperature higher than the highest color formation starting temperature among the recording layers constituting the recording medium 7 followed by cooling.

In a case of conducting the image forming method described above, explanation is to be made for the relation with the image forming device shown in FIG. 1.

The image forming device has the heat generating body L for initialization and heat generating bodies H1, H2 and H3 for image formation. The heat generating body for initialization is set such that the entire surface of all the recording layers can be heated to temperature T1 and the entire recording layers 2 cause color formation by passing through the portion to conduct initialization, even when the color image has already been formed to the recording medium 7.

Subsequently, the recording medium 7 passes through the image forming section comprising the heat generating bodies H1, H2 and H3 for forming images capable of applying heat imagewise. Among them, the heat generating body H1 is for erasing the color of the recording layer 2C, generates heat such that the recording medium can be heated imagewise to temperature T2 and erase the color of the recording layer 2C among the recording layers 2A, 2B, 2C causing color formation by the heat generating body L. Successive, heat generating body H2 and heat generating body H3 are adapted such that the recording layer 2 can be heated to temperature T3 and T4 respectively and they generate heat as required imagewise to erase desired color in the recording layers 2A and 2B causing color formation by the heat generating body L.

Figure 3:
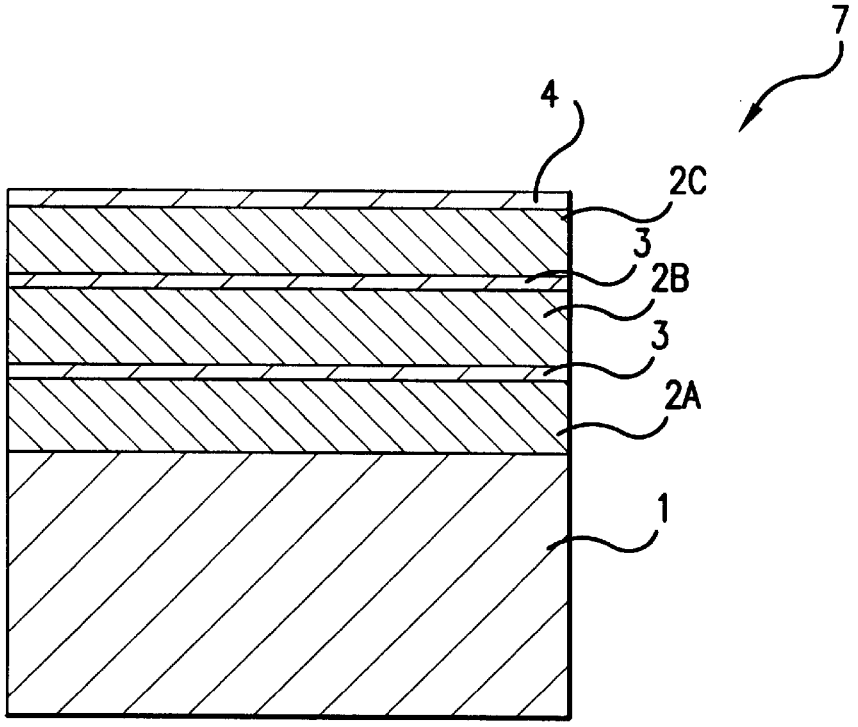
FIG. 3 is an explanatory cross sectional view illustrating the constitution of a reversible heat sensitive color recording medium.

Specifically, if an image area requires only the color of the recording layer 2C in FIG. 3, heating is applied corresponding to the image information such that the portion can be heated to temperature T2 by the heat generating body H1 and the heat generating body H1 and the heat generating body H3 heat the entire surface of the recording medium to temperature T3 and temperature T4 respectively. Accordingly, an image is formed to the recording layer 2C by passage through the heat generating body H1, the color of the recording color 2B is erased by passage through the heat generating body H2, and the color of the recording layer 2A is erased by passage through the heat generating body 3, so that only the color for the recording layer 2C remains in the image area of the recording medium 7. Further, in a case where the recording medium 7 comprises a plurality kinds of microcapsules, each of the recording layers 2 may be considered as identical with each of the microcapsules, and the color image can be formed efficiently by the device shown in FIG. 1.

Table 4 collectively shows the steps of forming the image as described above, and formation of the image by color formation of the recording layers 2A, 2B and 2C is conducted by four steps of heating.

Further, all the colors for the reversible heat sensitive recording layers 2 or the microcapsules 5 can be controlled by the heat generating body H in the image recording area in which the heat generating body L for the entire color erasing portion can be saved. That is, when the heat generating area which can be heated imagewise is heated entirely in the heat generating body H, it can serve also as the heat generating body L. In this case, it is necessary to pass the recording medium

TABLE 4

| | Heating device | Heating temperature | Heating region | Process |
|---|---|---|---|---|
| 1 | L | T1 | Entire surface | A, B, C layers initialized (A, B, C layers form color) |
| 2 | H1 | T2 | Imagewise (Non-image area) | C layer image-formed (C layer non-image area erased) |
| 3 | H2 | T3 | Entire surface | B layer image-formed (B layer non-image area erased) |
| 4 | H3 | T4 | Entire surface | A layer image-formed (A layer non-image area erased) |

7 through the heat generating body H for several times (for conducting entire heating and imagewise heating).

In the reversible heat sensitive color recording medium 7 used in the present invention, if a portion of the recording layers or the microcapsules is nonreversible, effective image formation and erasure are possible by using the same device as that for the case where the entire layers or entire microcapsules are reversible. As a matter of fact, however, not all the entire layers or all the microcapsules can be initialized but color formation of the not reversible composition remains. The state of image formation and erasure in a case where the nonreversible compositions are present, only the reversible composition may be considered as a target.

Figure 7:
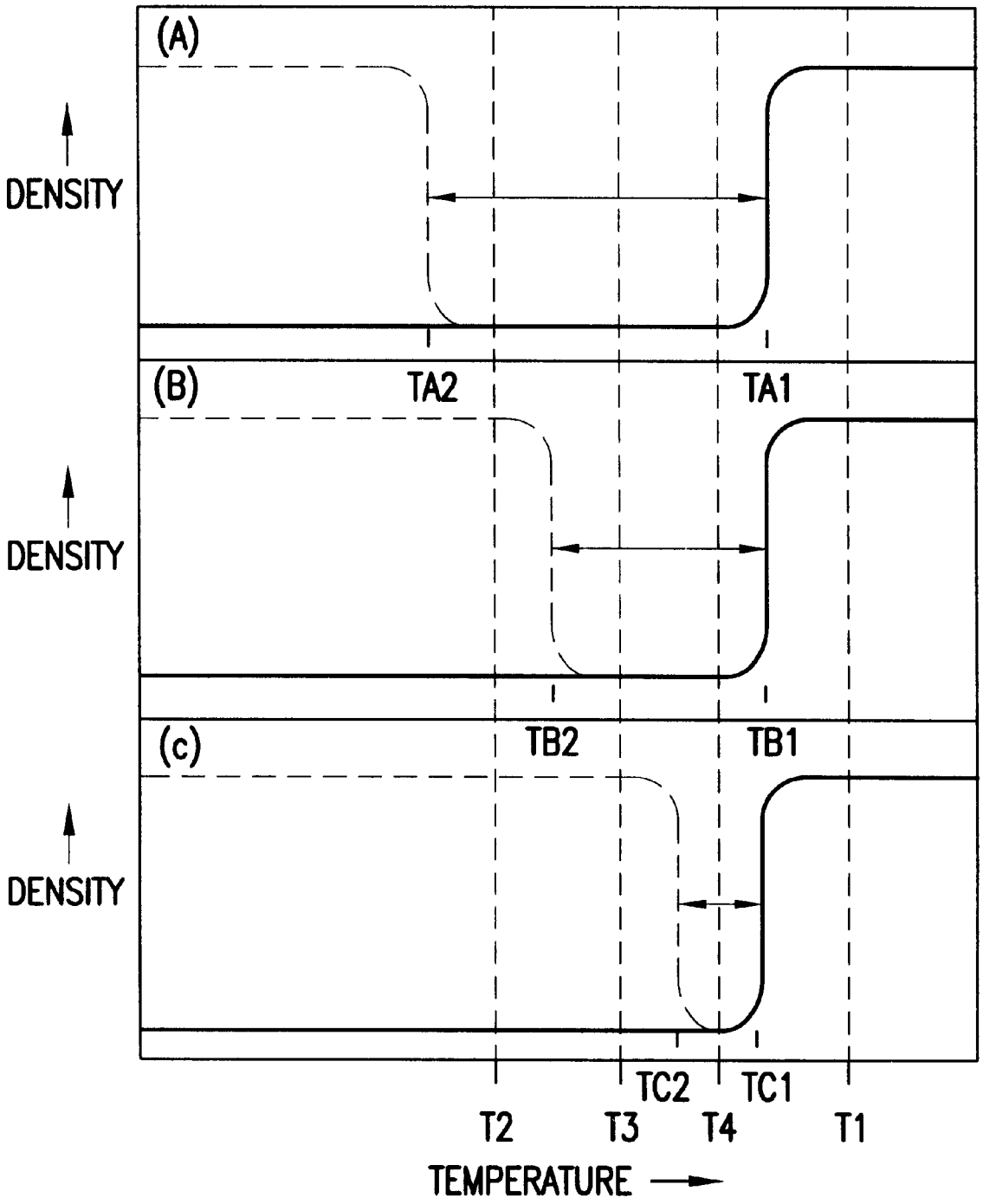
FIGS. 7A, 7B and 7C are views showing a relationship between the density and the temperature of each of the layers constituting the recording layers of the reversible heat sensitive color recording medium.

In the embodiment described above, as shown in FIG. 6, explanation has been made in a case of preparing each of the recording layers 2A, 2B and 2C with a plurality kinds of reversible heat color forming compositions having the temperature regions between the color formation starting temperature and the color erasure starting temperature different from each other. However, as shown in FIG. 7, the plurality kinds of the reversible heat color forming compositions constituting the recording layers 2A, 2B and 2C may have the color formation temperatures TA1, TB1, TC1 substantially equal with each other, only the color erasure starting temperatures TA2, TB2 and TC2 being different from each other. Corresponding to FIG. 3, the recording layers 2A, 2B and 2C of the recording medium 7 have the color erasure starting temperatures TA2, TB2 and TC2, respectively.

In this case, in the image forming method described above when heating applied not imagewise by the heat generating bodies H1, H2, and H3 for forming images at temperatures which are different successively, mono-colors and mixed colors can be obtained for each of the recording layers by heating successively from the lower color erasure starting temperature. That is, when image forming heating is applied in the order of temperatures T2 (TA2<T2 <TB2), T3 (TB2<T3<TC2) and T4 (TC2<T4<TC1), images can be formed by the same number of temperature setting as in the case of using the reversible thermally color forming compositions in FIG. 6.

<Working Example 1>

Figure 8:
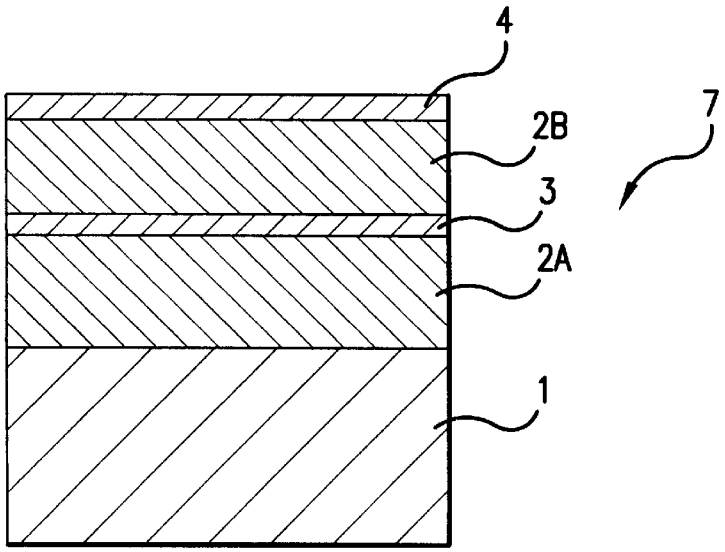
FIG. 8 is an explanatory cross sectional view illustrating the constitution of a reversible heat sensitive color recording medium.

Working examples of the present invention are to be explained with reference to FIGS. 8 and 9. A composition comprising 10 parts of 2-(N-methyl)anilino-6-(N-ethyl-p-toluidino) fluorane as a color former, 45 parts of dococyl phosphonic acid as a developer, 45 parts of vinyl chloride-vinyl acetate copolymer as a binder and 200 parts of toluene and 200 parts of methylethyl ketone as a solvent was thoroughly pulverized and dispersed by a ball mill into a grain size of about 1 $\mu$m, to prepare a coating solution A for forming a recording layer.

A composition comprising 10 parts of 2-methyl-6-(N-ethyl-p-toluidino) fluorane as a color former, 35 parts of hexadecyl phosphonic acid as a developer, 45 parts of vinyl chloride-vinyl acetate copolymer as a binder and 200 parts of toluene and 200 parts of methylethyl ketone as a solvent was thoroughly pulverized and dispersed by a ball mill into a grain size of about 1 $\mu$m, to prepare a coating solution B for forming a recording layer.

Then, the coating solution A was coated and dried on a support plate 1 made of a polyester film of 125 μm thickness to provide a recording layer 2A of about 5 μm thickness. The recording layer 2A turned green upon color formation. Then, an aqueous 10 wt % solution of polyvinyl alcohol was coated on the recording layer 2A to provide an intermediate resin layer 3 of about 2 μm thickness.

Further, the coating solution B was coated and dried on the intermediate resin layer 3 to provide a recording layer 2B of about 5 μm thickness. The recording layer 2B turned red upon color formation. On the other hand, a solution of a saturated polyester resin in toluene and methyl ethylketone was coated and dried as an adhesive layer on one surface of a protection layer 4 comprising a polyester film of 4.5 μm thickness. The thickness of the layer was about 0.5 μm.

Then, the film (protection layer 4) was laid over the recording layer 2B so as to be in contact with the adhesive layer and press-bonded by passing through a heat roller at a temperature of 125° C. under a pressure of about 2 kg (line pressure). As described above, a recording medium 7 comprising the recording layer 2A and the recording layer 2B on both sides of the intermediate resin layer 3 on the support plate 1 and further having the protection layer 4 on the surface was obtained.

The recording medium 7 was cooled rapidly by passing through a fixing device of an electrophotographic copying machine set to a temperature of about 180° C. (color forming temperature region of a composition having a color forming temperature on higher temperature side at the inside of the recording layer 2A and the recording layer 2B). Both of the recording layers of the recording medium 7 caused color formation by the procedures. A mixed color of color A (green) and color B (red), to attain an initial state in which the recording medium 7 was colored russet.

Figure 9A:
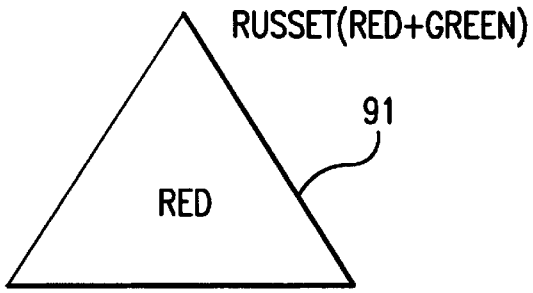
FIGS. 9A and 9B are explanatory views showing the image forming state of a recording medium of a preferred embodiment (actual example)
Figure 9B:
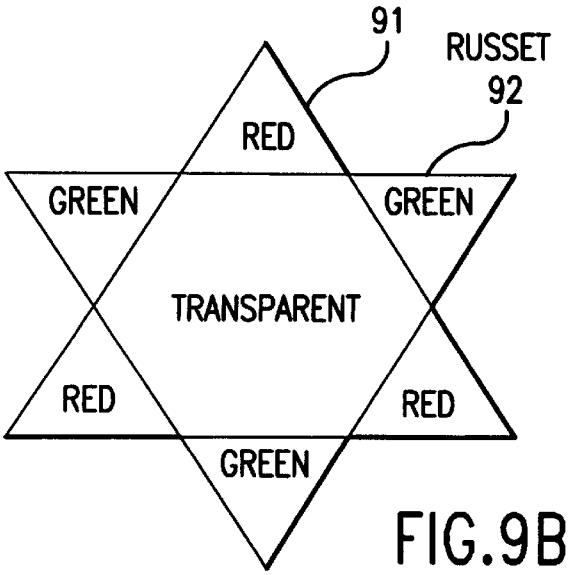

When a metal plate of a trigonal shape heated to 90° C. on a hot plate was pressed on the recording medium 7 followed by rapid cooling, a region corresponding to the trigonal shape 91 turned red (color A was erased and the color B was formed) as shown in FIG. 9A. When a metal plate having an inverted trigonal shape 92 (obtained by rotating the metal plate described above by 180 degree) heated to 70° C. on the hot plate was placed on the same recording medium 7, so as to overlap the region of the trigonal shape 91, followed by rapid cooling, the region in which the trigonal shape 91 and the inverted trigonal shape 92 overlapped to each other became transparent (color A and color B were erased), and the region not overlapped with the inverted trigonal shape 92 turned green (color B was erased, and only the color A was formed). The recording medium 7 could be initialized rapidly by the process described previously of passing through the fixing device of the electrophotographic copying machine set to a temperature of 130° C. followed by rapid cooling, and color formation and color erasure could be repeated stably.

<Working Example 2>

Figure 10:
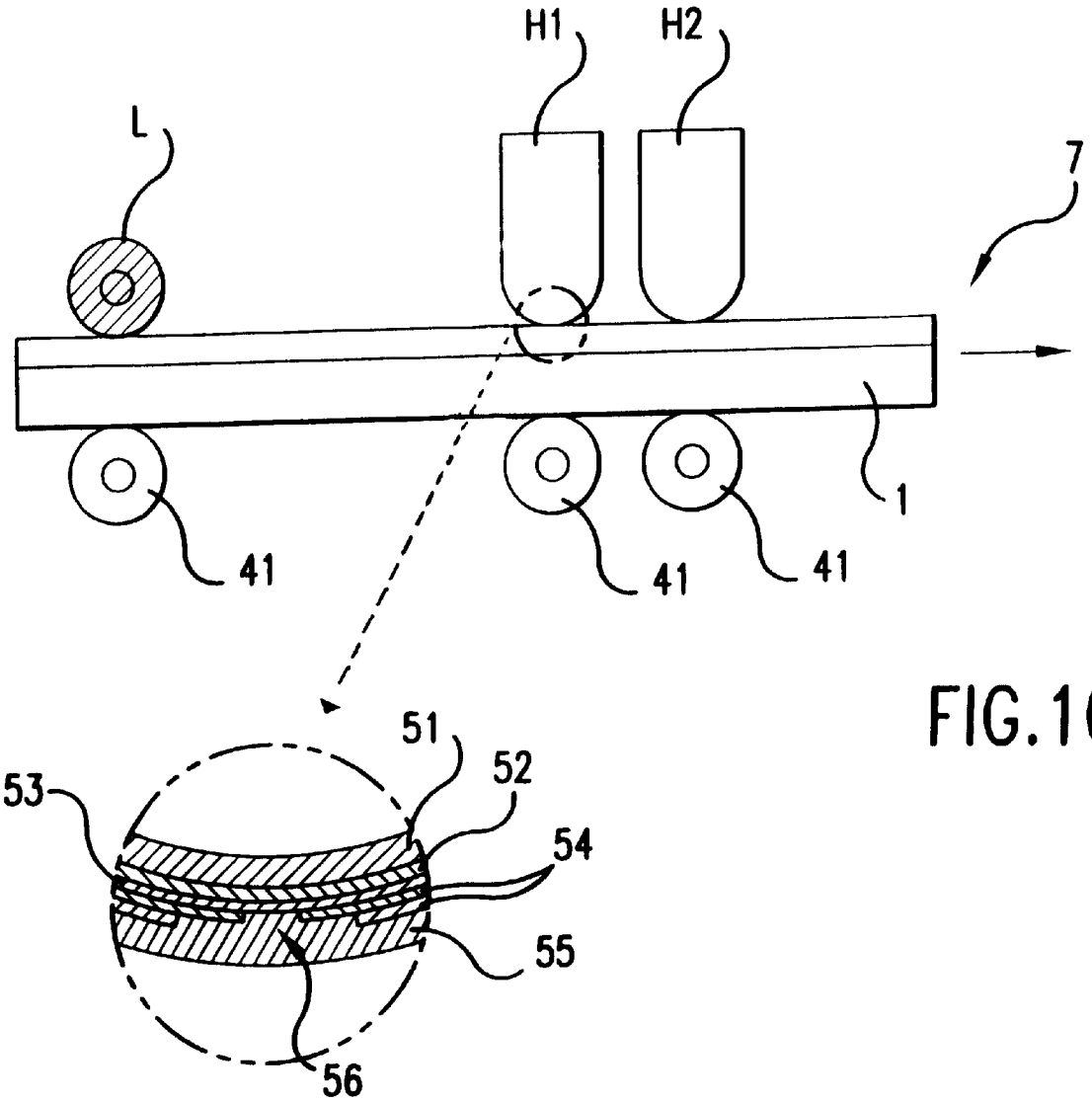
FIG. 10 is an explanatory view for the constitution of an image forming device of a preferred embodiment (actual example) according to the present invention.

Recording was conducted to the same recording medium as that in Working Example 1 by using an image forming device shown in FIG. 10. The image forming device mainly comprises a heat generating body L composed of a heat roller for entire heating (for initialization), a conveyor roller 41, heat generating bodies H1, H2 each comprising a thermal head composed of an aluminum substrate 51, a glaze layer 52, a thin resistive film 53, a lead layer 54, an abrasion resistant layer 55 and a heat generating portion 56 and showing 16/mm of resolution power.

Thermal recording was conducted while setting the temperature of the heat roller (initializing heat generating body) L to 130° C., maximum heating temperatures of the thermal heads (image forming heat generating bodies) H1, H2 to 90° C. and 70° C., respectively, and the moving speed from the left to the right of the recording medium 7 at 10 mm/second. The highest heating temperatures for the thermal heads H1 and H2 were controlled by pulse width modulation of a current supplying to the thermal heads. As a result, relative to the russet background, a pattern heated by the thermal head H1 appeared red, the pattern heated by the thermal head H2 appeared green, and the overlapped portion of the heating patterns turned colorless.

When another pattern was recorded by processing the recording medium 7 in the image forming device again, no printed pattern at the first time remained at all but only a new pattern was printed. Naturally, the new pattern formed a three color pattern of red, green and colorless relative to the russet background. A series of such procedures could be repeated stably over and over.

<Working Example 3>

Figure 11:
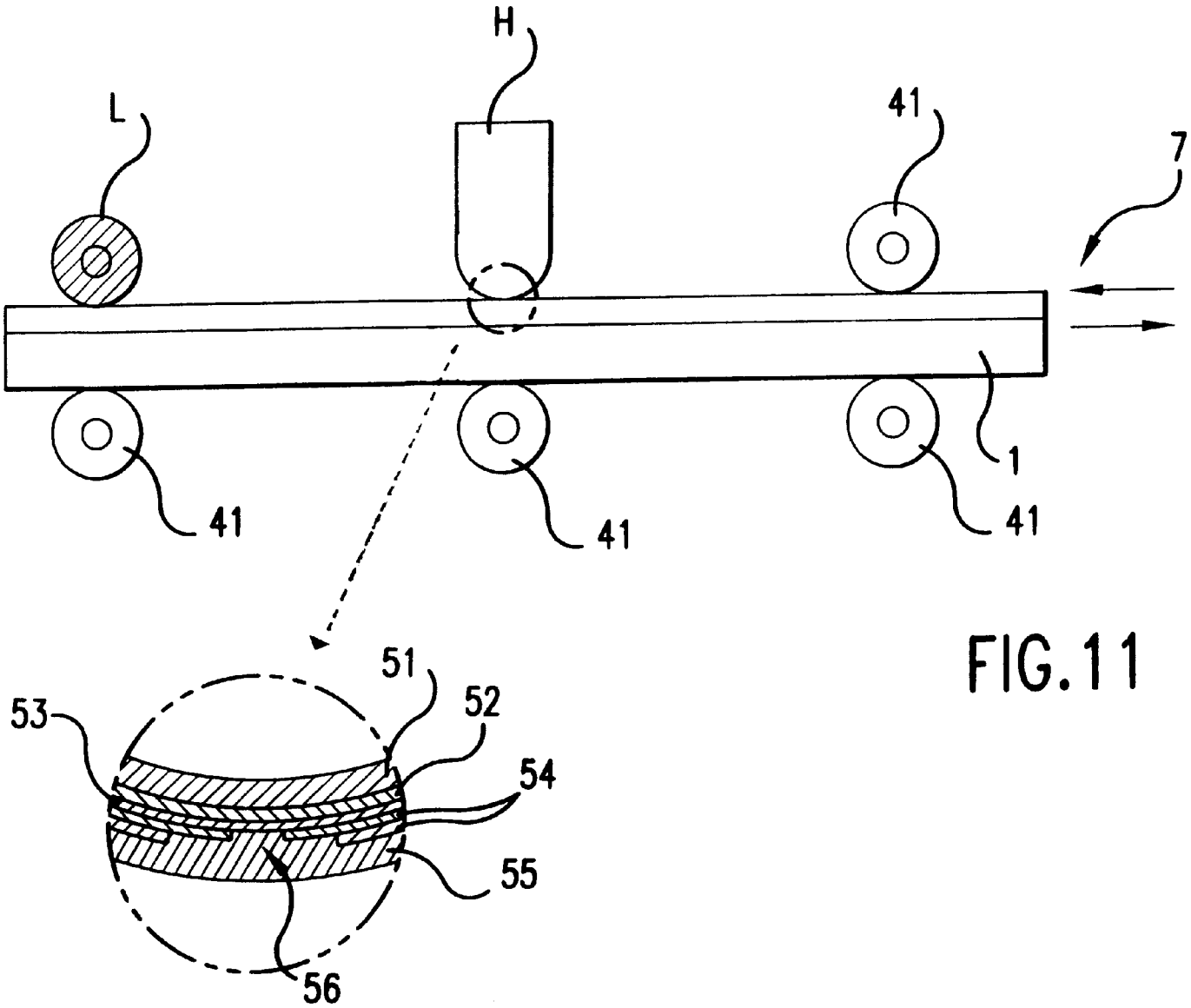
FIG. 11 is an explanatory view for the constitution of an image forming device of a preferred embodiment (actual example) according to the present invention.

Recording was conducted to the same recording medium as in Working Example 1 by using an image forming device as shown in FIG. 11. The parts or portions having the same constitutions as those in FIG. 10 carry the same reference numerals. In this working example, a group of image forming heat generating bodies are constituted with one thermal head H capable of temperature setting. The thermal head H has 16/mm of resolution power like that the thermal head in FIG. 10.

Thermal recording was conducted while setting the temperature of the heat roller L to 130° C., the highest heating temperature of the thermal head H to 90° C., respectively, and the moving speed of the recording medium at 100 mm/sec from the left to the right in the drawing. The highest heating temperature of the thermal head H was controlled by pulse width modulation of a current supplied to the thermal head. As a result, a pattern heated by the thermal head H appeared red relative to the russet background.

Thermal recording was conducted again to the same recording medium 7 while setting the temperature of the heat roller L at a room temperature, the highest heating temperature of the thermal head H at 70° C., respectively, and the moving speed of the recording medium 7 at 10 mm/sec from the right to the left in the drawing. As a result, the pattern heated by the thermal head 1 appeared green, and the portion overlapped with the red pattern turned colorless relative to the russet background. The temperature of the heat roller was set to the room temperature, so that each of the recording layers 2 of the recording medium 7 did not cause change such as color formation or color erasure in this portion.

When another pattern was recorded in the same procedures by processing the recording medium 7 again in the image forming device, no printed pattern at the first time remained at all and only the new pattern was printed. Naturally, the new pattern formed a three color pattern of red, green and colorless relative to the russet background. A series of the procedures could be repeated over and over.

Figure 12:
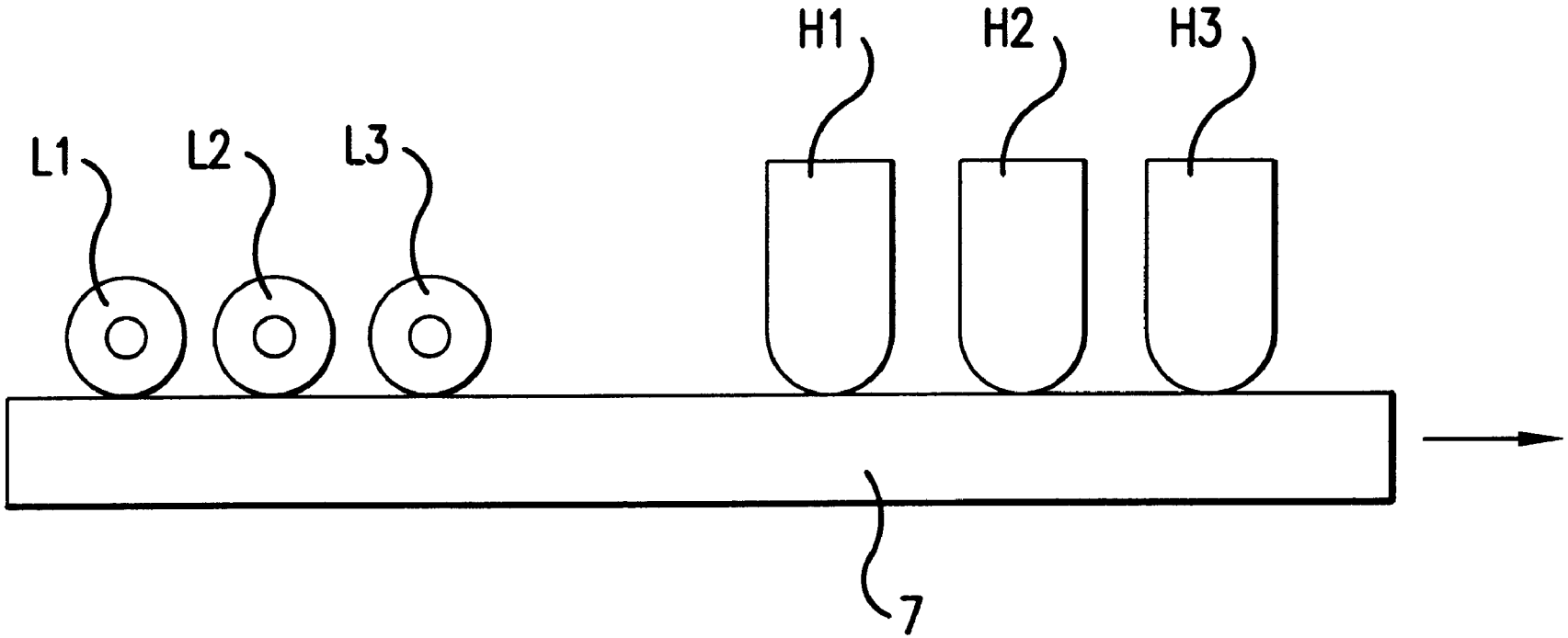
FIG. 12 is an explanatory view for the constitution of an image forming device of the prior art.

According to the image forming device shown in the embodiments and the working examples, it may suffice to provide only one heat roller (heat generating body) for entire heating (for initialization), and the device can be simplified in the structure and reduced in the size as compared with the prior art device (FIG. 12) in which the heat rollers are disposed by the number of the recording layers 2 constituting the recording medium 7.

What is claimed is:

1. A method of forming a reversible multi-color image to a reversible heat sensitive color recording medium in which recording layers each independently contain a plurality of kinds of reversible heat color forming compositions having tones of formed color and color erasure starting temperatures different from each other are formed on a support, said method comprising:

heating the reversible heat sensitive color recording medium entirely thereby causing color formation to the plurality of kinds of the reversible heat color forming compositions of the reversible heat sensitive color recording medium; and then heating an image area or non-image area so as to be in a color erasing temperature region of a reversible heat color forming composition and erasing the color of the image area or the non-image area thereby forming a multi-color image.

2. A method of forming a reversible color image as defined in claim 1, wherein when the image area or the non-image area is heated, said image area or the non-image area is heated so as to be in the color erasing temperature region in the order from the reversible heat color forming composition having a higher color erasure starting temperature to the reversible heat color forming composition having a lower color erasure starting temperature among the plurality kinds of the reversible heat color forming compositions, and the color of the image area or the non-image area is erased, thereby forming the multi-color image.

3. A method of forming a reversible color image as defined in claim 1, wherein the color forming temperatures of the plurality kinds of the reversible heat color forming compositions are substantially identical with each other and, when the image area or the non-image area is heated, said image area or the non-image area is heated such that the color erasure starting temperature of the plurality kinds of the reversible heat color forming compositions are in the color erasing temperature region in the order from the reversible heat color forming composition having a higher color erasure starting temperature to the reversible heat color forming composition having a lower color erasure starting temperature.

4. A device for forming a reversible multi-color images comprising:

a reversible heat sensitive color recording medium in which recording layers are formed on a support each recording layer independently containing a plurality of kinds of reversible heat color forming compositions having tones of formed color and color erasure starting temperatures different from each other;

a first heating means for heating the reversible heat sensitive color recording medium entirely thereby causing color formation for the plurality of kinds of reversible heat color forming compositions of the reversible heat sensitive color recording medium; and a second heating means for heating an image area or non-image area to a color erasing temperature region of a reversible heat color forming composition.

5. A device for forming a reversible color image as defined in claim 4, wherein the heating temperature of the second heating means is a temperature in a color erasing temperature region of a reversible heat color forming composition having a higher color erasure starting temperature among the plurality kinds of reversible heat color forming compositions.

6. A device for forming a reversible color image as defined in claim 4, wherein the color forming temperatures of the plurality kinds of the reversible heat color forming compositions are substantially identical with each other, and the heating temperature of the second heating means is a temperature in a color erasing temperature region of a reversible heat color forming composition having a lower color erasure starting temperature among the plurality kinds of reversible heat color forming compositions.

* * * * *